US006454481B1

(12) United States Patent
Izumi

(10) Patent No.: US 6,454,481 B1
(45) Date of Patent: Sep. 24, 2002

(54) INK FOLLOWER IN CONJUNCTION WITH INK IN A WRITING INSTRUMENT AND WRITING INSTRUMENT CONTAINING THE SAME

(75) Inventor: Seishi Izumi, Kanagawa (JP)

(73) Assignee: Kabushiki Kaisha Pilot, Tokyo (JP)

( * ) Notice: Subject to any disclaimer, the term of this patent is extended or adjusted under 35 U.S.C. 154(b) by 0 days.

(21) Appl. No.: 09/685,074

(22) Filed: Oct. 10, 2000

(30) Foreign Application Priority Data

Oct. 13, 1999 (JP) ..... H11-325867

(51) Int. Cl.[7] ..... B43K 7/08
(52) U.S. Cl. ..... 401/142; 401/141
(58) Field of Search ..... 401/142, 141

(56) References Cited

U.S. PATENT DOCUMENTS 3,526,522 A * 9/1970 Seregely ..... 106/270
3,656,857 A * 4/1972 Seregely ..... 401/142
4,671,691 A * 6/1987 Case et al. ..... 401/142
5,374,600 A * 12/1994 Hozumi et al. ..... 502/402
6,132,124 A * 10/2000 Ogura et al. ..... 401/141
6,200,053 B1 * 3/2001 Asami et al. ..... 401/142

* cited by examiner

*Primary Examiner*—Gregory Huson
*Assistant Examiner*—Huyen Le
(74) *Attorney, Agent, or Firm*—Rader, Fishman & Grauer PLLC

(57) ABSTRACT

An ink follower for a writing tool comprises a swollen gel formed from an oil-absorbable resin and a base oil, i.e., a hardly volatile liquid and/or a nonvolatile liquid. The ink follower is arranged in contact with the ink surface of a writing tool such as a pen. A writing tool using the ink follower has excellent impact resistance without causing insufficient following and oil separation with the passage of time and with no occurrence of inconvenience in writing.

14 Claims, 1 Drawing Sheet

INK FOLLOWER IN CONJUNCTION WITH INK IN A WRITING INSTRUMENT AND WRITING INSTRUMENT CONTAINING THE SAME

FIELD OF THE INVENTION

The present invention relates to an ink follower for a writing tool and a writing tool at which the same is arranged. More particularly, for the purpose of the prevention of evaporation of water or an organic solvent in ink during storage or in use and the prevention of leaking or flow backward of ink in the writing tool where ink for writing is directly contained in an ink-containing reservoir, the invention relates to an ink follower for the writing tool which is charged in contact with the ink at the terminal part opposite to the part of the ink reservoir to which an writing tip is attached.

BACKGROUND OF THE INVENTION

Hitherto, in a writing tool where ink for writing is directly contained in an ink-containing reservoir, e.g., a ballpoint pen, an ink follower is charged in contact with the ink at the terminal part of the ink reservoir for the purpose of the prevention of evaporation, leaking or flow backward of the ink. Such ink follower should be hardly volatile and have high apparent viscosity. For that purpose, ink followers where an organic or inorganic thickening agent, a gelling agent or the like is added to a base oil of a hardly volatile liquid or a nonvolatile liquid have been known.

For example, Japanese Patent Publication No. 64 -10554/1989 proposes a composition where an organic gelling agent such as dibenzylidene sorbitol is added to a hardly volatile solvent such as ethylene glycol, and Japanese Patent Application Laid-Open Publication No. 57-200472/1982 proposes a composition where an thickening agent such as an amino acid derivative is dissolved in polybutene or the like to form a gel.

In addition, those where an organic or inorganic thickening agent, a gelling agent or the like is added to a base oil of a hardly volatile liquid or a nonvolatile liquid and a specific additive is further added for the purpose of improving the performance are proposed in Japanese Patent Publication Nos. 5-82804/1993, 6-15277/1994, 6-33024/1994, 6-33025/1994, 6-33026/1994, 6-47318/1994, 7-17872/1995, 7-29513/1995, Japanese Patent No. 2677734, Japanese Patent Application Laid-Open Publication Nos. 4-202281/1992, 5-270193/1993, 6-200235/1994, 7-216285/1995, 8-11481/1996, 8-300874/1996, 9-234988/1997 and so forth.

In these gelling methods of the ink followers, gels are thickened by the network formation between the molecules of the gelling agents. In such system, since the gels are further thickened through the expansion of the networks between the molecules with the passage of time, there is a problem that the ink followers in which these gels are used become hard and difficult to follow ink. As a result, with the passage of time, insufficient following of the ink followers is observed in the ballpoint pens where such ink followers are arranged and there occur problems that writing lines become patchy and writing with the pen becomes impossible.

When the addition of the gelling agent is reduced in order to avoid these problems, the problem that the ink followers become hard with the passage of time is solved but impact resistance becomes insufficient and leaking and back leaking of the ink occur. Furthermore, oil separation, i.e., partial separation of the base oil occurs as time passed. Since the separated liquid is often lighter than ink, the separated liquid goes up through the ink and stays in the tip of a ballpoint pen to cause inconvenience in writing at the ballpoint pen which is left to stand with the tip upward.

In addition, Japanese Patent Application Laid-Open Publication No. 8-142570/1996 proposes an ink follower where a phthalate ester-type plasticizer and a polyester-type thermoplastic elastomer are combined. In the ink follower, it is attempted to cope with both the stability during the passage of time and the control of flow rate of ink but the ink follower is inferior in impact resistance, so that there is a problem that ink leaks out when external force is imposed by, for example, falling, vibration or the like.

In such situations, for enhancing impact resistance, the addition of non-swellable particles having a similar specific gravity to that of the base oil and a particle size of several tens to several hundreds $\mu$m or the incorporation of rod-shaped materials of several mm is proposed in Japanese Patent Application Laid-Open Publication Nos. 10-44673/1998 and 10-67196/1998 but the problem of the oil separation is not yet solved.

As described above, there is no proposal of the ink follower having sufficient stability during the passage of time, impact resistance and ink-following ability as well as showing no oil separation.

SUMMARY OF THE INVENTION

An object of the present invention is to provide an ink follower for a writing tool having enhanced impact resistance without causing insufficient following and oil separation with the passage of time as well as with no inconvenience in writing, and to provide a writing tool at which the same is arranged. This invention relates to an ink follower for a writing tool comprising a swollen gel formed from an oil-absorbable resin and a base oil of a hardly volatile liquid and/or a nonvolatile liquid, wherein the ink follower is arranged in contact with the ink surface opposite to the part of an ink reservoir to which a writing tip is attached.

The present invention also relates to a writing tool wherein ink is directly charged into an ink reservoir and an ink follower is arranged in contact with the ink surface opposite to the part to which a writing tip is attached. The oil-absorbable resin may be a polymer having lipophilicity. The swollen gel which forms the ink follower may be a gel having a particle size of 30 to 2000 $\mu$m. The swollen gel which forms the ink follower may be a mixture of a gel having a particle size of 30 to 100 $\mu$m and a gel having a particle size of 300 to 1500 $\mu$m. The amount of the oil-absorbable resin may be from 10 to 20% by weight of the ink follower. The oil-absorbable resin is one or more selected from acrylate ester crosslinked polymers and/or copolymers thereof, methacrylate ester crosslinked polymers and/or copolymers thereof, and polynorbornene.

Further, the writing tool may be the one that a writing tip is directly attached to an ink reservoir. Alternatively, the writing tool may be the other that a writing tip is attached to an ink reservoir through an ink-feed controller.

PREFERRED EMBODIMENTS OF THE INVENTIONS

Figure 1:
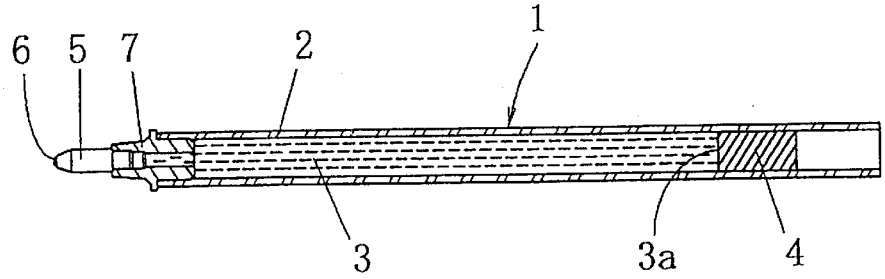
FIGS. 1 and 2 show cross sectional views of an ink reservoir used for a writing tool which contains an ink follower of the present invention, in particular, an ink reservoir for refilling body for exchange.

The ink follower of the present invention composes a swollen gel obtained by mixing an oil-absorbable resin and a base oil, i.e., a hardly volatile liquid and/or a nonvolatile liquid, and swelling the oil-absorbable resin.

The oil-absorbable resin to be used in the present invention is a resin having a property of holding the base oil which is a hardly volatile liquid and/or a nonvolatile liquid through swelling after absorbing the oil, and a desired ink follower may be obtained by using one of the resins or two or more of the resins in combination.

The oil-absorbable resin becomes a swollen almost spherical material in the ink follower, and the swollen resin having a particle size of 30 to 2000 μm is preferably used. The use of the combination of an oil-absorbable resin having a particle size within the range and a base oil is preferable owing to particularly enhanced properties of impact resistance and following ability. When the size is smaller than 30 μm, the resulting follower is still practical but shows tendency of slightly deteriorated impact resistance. When the size exceeds 2000 μm, the resulting follower is also within a practical range but shows tendency of slightly deteriorated following ability.

The use of a mixture of a swollen resin having a particle size of 30 to 100 μm and that having a particle size of 300 to 1500 μm is particularly preferred because of good enhancement of the performance as the follower.

Incidentally, the particle size in the present invention expresses the range of particle size in which too large and too small ones among the almost spherical materials are excluded and 80% or more of the materials are included.

As the oil-absorbable resin to be used in the present invention, there may be mentioned an acrylate ester crosslinked polymer and/or copolymer thereof, a methacrylate ester crosslinked polymer and/or copolymer thereof, and polynorbornene. More particularly, a crosslinked copolymer from a monomer having one polymerizable unsaturated group in the molecule selected from the following general formula (I) and a crosslinking monomer having at least two polymerizable unsaturated groups in the molecule may be mentioned as the an acrylate ester crosslinked polymer and/or copolymer thereof, a methacrylate ester crosslinked polymer and/or copolymer thereof.

General formula (I):

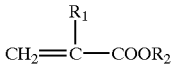

(I)

(wherein, $R_1$ is hydrogen or methyl group, and $R_2$ is a aliphatic hydrocarbon group having 10 to 16 carbon atoms.)

The examples of the crosslinking monomer having at least two polymerizable unsaturated groups in the molecule include acrylates or methacrylates of glycols such as ethylene glycol, diethylene glycol, polyethylene glycol, polypropylene glycol, 1,3-butylene glycol and 1,6-hexane glycol; acrylamides such as N,N'-methylenebisacrylamide, N,N'-propyleneacrylamide; polyfunctional acrylates or methacrylates of polyhydric alcohols such as glycerin, trimethylolpropane, trimethylolethane and tetramethylolmethane or alkylene oxide adducts thereof; and divinylbenzene.

The following exemplify the crosslinked polymers to be used in the present invention.

As the acrylate ester crosslinked polymers, there may be mentioned a crosslinked polymer composed of 99.734% by weight of decyl acrylate and 0.266% by weight of 1,6-hexanediol acrylate, a crosslinked polymer composed of 99.823% by weight of dodecyl acrylate and 0.177% by weight of ethylene glycol diacrylate, a crosslinked polymer composed of 92.308% by weight of dodecyl acrylate and 7.692% by weight of polypropylene glycol dimethacrylate (Mw 4000), and the like.

As the acrylate ester crosslinked copolymers, a crosslinked polymer composed of 57.7724% by weight of dodecyl acrylate, 38.515% by weight of N,N-dioctylacrylamide and 3.713% by weight of polypropylene glycol dimethacrylate (Mw 4000) and the like may be mentioned.

As the methacrylate ester crosslinked polymers, a crosslinked polymer composed of 99.895% by weight of hexadecyl methacrylate and 0.105% by weight of divinylbenzene and the like may be mentioned.

As the methacrylate ester crosslinked copolymers, there may be mentioned a crosslinked polymer composed of 49.930% by weight of hexadecyl methacrylate, 49.930% by weight of N-octylmethacrylamide and 0.140% by weight of divinylbenzen, a crosslinked polymer composed of 59.908% by weight of hexadecyl methacrylate, 39.938% by weight of butyl methacrylate and 0.154% by weight of divinylbenzen, and the like.

The oil-absorbable resin to be used in the present invention is preferably obtained by polymerizing the monomer having at one polymerizable unsaturated groups in the molecule and the crosslinking monomer having at least two polymerizable unsaturated groups in the molecule in a ratio of 90 to 99.999% by weight: 0.001 to 10% by weight.

The more concrete examples of the oil-absorbable resin include OLEOSOAB PW-190, 170 (manufactured by Nippon Shokubai Co., Ltd.; an acrylate ester crosslinked polymers), NORSOREX (manufactured by Zeon Corporation; polynorbomene), and the like.

The amount of the oil-absorbable resin to be mixed may be the amount which is sufficient to absorb all the hardly volatile liquid and/or nonvolatile liquid, but a particularly preferable ink follower can be obtained by the use of the amount of 10 to 20% by weight based on total weight of the ink follower.

When the amount is less than 10% by weight, there is a possibility of occurrence of slight oil separation after the passage of time to an extent so as to cause no trouble in the writing performance of the writing tool. When it exceeds 20% by weight, there is a tendency of decrease of following ability to an extent so as to cause also no trouble in the writing performance of the writing tool.

The base oil which is a hardly volatile liquid and/or nonvolatile liquid to be used in the invention may be a mineral oil-type base oil or a synthetic base oil, and the examples include spindle oil, castor oil, olive oil, liquid paraffin, polybutene, soybean oil and the like. Particularly preferred are those having an SP value of 7 to 9. When the base oil having an SP value of the range is used, the oil absorbable resin exhibits its maximum oil-absorbing ability and even a little mixing amount is sufficient to obtain an aimed ink follower. These oils may be used solely or as a mixture of two or more of them.

In addition, the ink follower of the present invention may contain an additive such as silica or a higher fatty acid salt in an amount of 5% by weight or less based on the total weight of the follower.

In the ink follower for the writing tool of the present invention, an oil-absorbable resin absorbs a base oil composed of a hardly volatile liquid and/or nonvolatile liquid to form a swollen gel and the gel holds the base oil stably, so that the resulting ink follower is stable and shows almost no change in properties with the passage of time, which is different from the case of an intermolecular network-forming gel.

The oil-absorbable resin mainly constituting the ink follower exhibits substantially elastic behavior and contributes to the enhancement of back leaking inhibition and impact resistance.

It is not sufficient to elucidate academically the difference in the stability with the passage of time between a conventional ink follower based on an intermolecular network-forming gel and the ink follower of the present invention based on the swollen gel, but the present inventors considers the reasons as follows.

The intermolecular network-forming gel used in a conventional ink follower for a writing tool forms intermolecular networks and the gel strength is realized through the network formation and a hard gel is formed. Since the network structure is formed between molecules, the structure is easily destroyed by shear stress and the once destroyed structure has a weak gel strength for a while, whereby the gel becomes a soft gel.

In this type of network gel, the state where the network structure is formed is stable and therefore the soft gel where the structure has been destroyed is not stable and begins to return to the hard gel where an intermolecular network structure is formed. However, the structure formation occurs only gradually and, as a result, the physical properties after the passage of time become different from those at early stage. That is, since it takes a certain period of time to restore once destroyed structure to the intrinsic structure of the intermolecular network forming gel, there arises a problem in the stability of following ability with the passage of time.

Namely, the network forming state at the early stage when ink follower has been arranged is a soft state where the network structure has been destroyed to some extent during the production, and is different from the network forming state of the ink follower after the passage of time where the structure is restored to form a hard gel.

Accordingly, in the case where design is carried out so as to show a good performance with the ink follower at the early stage, the ink follower after the passage of time is too hard, and bad following ability is resulted in. To the contrary, in the case that the design is carried out so as to show a good performance with the ink follower after the passage of time, the ink follower at the early stage is too soft and is insufficient to prevent leaking or flow backward of ink.

On the other hand, the swollen gel used in the ink follower of the present invention has a structure where the base oil is held in crosslinked polymer chains within molecules of the oil-absorbable resin by van der Waals force. The structure formation for gelation occurs when the oil-absorbable resin absorbs the hardly volatile liquid and/or nonvolatile liquid. Since the gel has already had a complete structure after the absorption, no further structure formation occurs and the change of physical properties like the case of the intermolecular network forming gel does not occur with the passage of time. Moreover, the gel structure is formed not between molecules but within each molecule, so that the destruction of the structure does not occur by the shearing which occurs when an ink follower is arranged at an ink reservoir unlike the above intermolecular network forming gel. Therefore, the intrinsic structure of the swollen gel is restored immediately at the time when the shear stress is removed. Namely, since the ink follower of the present invention has an intrinsic structure at the time when the ink follower is arranged, it takes no time to restore the structure, so that the physical properties are almost the same at the early stage of the arrangement and after the passage of time. As described above, it is considered that the difference in time for restoring the intrinsic structures of the gels and the stability of the structures reflect the difference in the stability with the passage of time.

Furthermore, the oil-absorbable resin becomes a grease-like material exhibiting a strong elastic component, through the formation of a swollen gel by absorption of the base oil. The elastic component is considered to appear according to the following theory.

The swollen gel has a structure where the base oil is held in crosslinked polymer chains within molecules of the oil-absorbable resin by van der Waals force. Owing to the structure, the elastic behavior was realized by the interaction between the base oil held in the crosslinked structure and the crosslinked polymer.

Upon receiving external pressure, i.e., shear stress, the gel is pressed but, owing to the bonding by van der Waals force maintained between the both, tries to maintain the gel structure. In the case of only the base oil, since there is not a structure where it is held in a crosslinked structure, the base oil escapes to the place where the shear stress is not imposed and the gel tries to remove the shear stress through its deformation. As a result, the gel will not be restored to the original structure and therefore no elastic behavior is observed.

On the other hand, in the resin which holds no base oil and is not swollen, the crosslinked structure contains only air. Therefore, when shear stress is applied, only the air escapes and the gel will not be restored to the original structure and thus no elastic behavior is observed. As mentioned above, each component alone hardly exhibits elastic behavior but when the swollen gel is formed, the gel acts as elastic body so as to restore the stable structure of the gel form as soon as possible through the interaction of both components. Thus, in the case that elastic component is strong, a certain strength of external impact does not cause any deformation which may be caused by the absorption of the impact but only results in the strain in the molecule, so that the force for restoring the intrinsic state strongly works, and as a result, the original form of the ink follower is maintained and thus the gel exhibits enhanced impact resistance.

Furthermore, since the swollen gel has a structure where the base oil is held in crosslinked polymer chains within the molecules of the oil-absorbable resin by van der Waals force, the base oil once held in the molecule is resistant to the separation even when an external factor such as shear stress or heating is applied and the follower in the grease state hardly causes oil separation.

Thus, the ink follower of this invention exhibits excellent properties such as stability with the passage of time, impact resistance, oil separation and the like.

As the ink used for the writing tool containing the ink follower of the present invention, an ink usually used for a writing tool generally employed for writing is used and there may be mentioned a water-base or oil-base ink in which a coloring agent such as a dye or a pigment and a shielding agent such as titanium oxide are dissolved and/or dispersed.

Furthermore, it is desirable to use a type of ink where the SP value of main solvent of the ink is quite different from the SP value of the base oil of the ink follower of the present invention. When the SP value of main solvent of the ink is the same level as the SP value of the base oil of the ink follower, there are the risks that the ink follower is mixed with the ink and the oil-absorbable resin absorbs the solvent in the ink, and therefore, the writing tool would fail to work as a writing tool.

Figure 2:
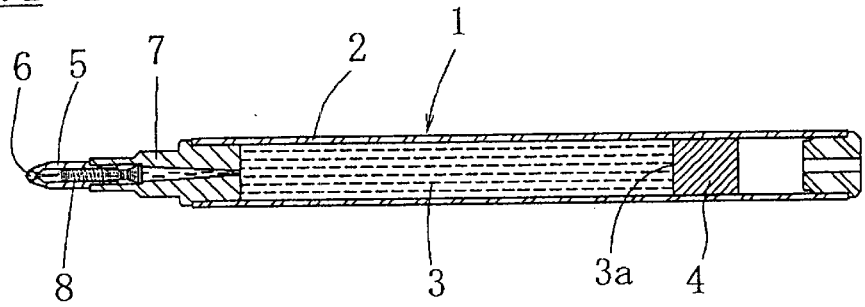
Figure 3:
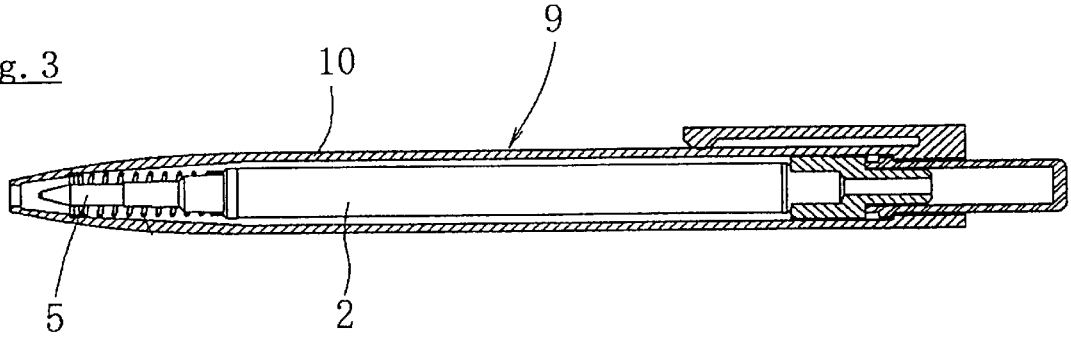
FIG. 3 shows a cross sectional view of a writing tool of a refill-type having an ink follower of the present invention, wherein the ink reservoir is replaceable.

FIGS. 1 and 2 shows a refill body 1 containing ink follower 4 for use of refilling a writing tool. An ink reservoir 2 is made of resin such as polyethylene or polypropylene or of glass, metal and the like, which is optionally treated with a water-repellent or an oil-repellant. The ink reservoir 2 is filled with the ink 3 aforementioned. The ink reservoir 2 is connected with a writing tip 5 directly or through an ink feed controller 8 such as a valve. A ball 6 is arranged at one end of the writing tip 5. Further, the other end of the writing tip 5 is attached to an attachment part 7 for attaching the writing tip at one end of the ink reservoir 2. An ink follower 4 is arranged in contact with the ink surface 3 a opposite to the part of the ink reservoir 2 to which the writing tip 5 is attached. The ink feed controller 8 may be arranged to the writing tip 5, as shown in FIG. 2. As examples of the ink feed controller, there may be mentioned a spring, a valve mechanism made of a processed material such as a resin or an elastomer, and the like may be mentioned. As the writing tip, a ballpoint pen tip, a continuously connected porous body, a fiber-like tip produced by tying a fibrous material such as felt, a pipe-shape tip, and the like. Further, a writing tool containing the ink reservoir 2 of the present invention may be what the ink reservoir 2 also serves as the outer part 10 of the writing tool, as shown in FIG. 1 or FIG. 2. Furthermore, as shown in FIG. 3, a writing tool 9 containing the ink follower 4 of the present invention may be a type that the ink reservoir 2 and the outer part 10 of the writing tool are separated and the ink reservoir 2 is a replaceable body.

EXAMPLES

Mixing Example 1 (Ink for Ballpoint Pen with Water-base Ink)

The following components were mixed, dispersed under stirring, and then filtered to obtain an ink for a ballpoint pen with a water-base ink.

| | |
|---|---|
| Black pigment dispersion (20% of solid content) | 50.0% by weight |
| Glycerin (a wetting agent) | 20.0% by weight |
| HIVISWAKO 104 (manufactured by Wako Pure Chemical Industries, Ltd.; a thickening agent; an acrylic acid crosslinked polymer) | 0.5% by weight |
| pH regulator (triethanolamine) | 0.8% by weight |
| PLYSURF A208S (manufactured by Dai-ichi Kogyo Seiyaku Co., Ltd.; a lubricant; a polyoxyethylene alkyl ether) | 1.0% by weight |
| Water | 27.7% by weight |
| "Examples"; | |
| Polybutene HV-15 (manufactured by Nippon Petrochemicals Co., Ltd.) | 85.0% by weight |
| OLEOSOAB PW-170 (manufactured by Nippon Shokubai Co., Ltd.; an acrylate ester crosslinked polymer) | 15.0% by weight |

The above components were mixed under heating at 140° C. and cooled to room temperature to obtain a grease-like ink follower for a writing tool.

When the ink follower for the writing tool is observed on an optical microscope, it was found that the oil absorbable resin absorbed the hardly volatile liquid to a form swollen gel having particle size of 50 to 100 $\mu$m.

Thereafter, about 1.0 g of the ink of Mixing Example 1 was charged into a polypropylene tube having an inner diameter of 4 mm fitted with a ballpoint pen tip (ultra hard ball having a diameter $\phi$ of 0.7 mm) made of stainless steel at the one end and 0.1 g of the ink follower for the writing tool obtained herein was charged to the other end to obtain a refill for a ballpoint pen with a water-base ink. The refill was attached to outer parts for a water-base gel ink ballpoint pen to obtain a ballpoint pen with a water-base ink.

About 1.0 g of the ink of Mixing Example 1 was charged into a polypropylene tube having an inner diameter of 4 mm fitted with a ballpoint pen tip (ultra hard ball having a diameter $\phi$ of 0.7 mm) made of stainless steel and using a spring valve as the ink feed controller at the one end and 0.1 of the ink follower for the writing tool obtained herein was charged to the other end to obtain a refill for a ballpoint pen with a water-base gel ink. The refill was attached to an outer part for a water-base gel ink ballpoint pen to obtain a second ballpoint pen with a water-base ink.

Examples 2 to 8

Ink followers for writing tools were obtained using res described in Table 1 in a similar manner to Example 1, spectively. Thereafter, two kinds of ballpoint pens with a water-base ink were obtained in a similar manner to Examples 1.

TABLE 1

| Example No. | Hardly volatile or nonvolatile liquid (weight part) | Oil absorbable resin (weight part) | Particle size ($\mu$m) |
|---|---|---|---|
| 2 | Polybutene HV-15 90.9 | OLEOSOAB PW-170 9.09 | 50~100 |
| 3 | Polybutene HV-15 85.0 | OLEOSOAB PW-170 5.0 | 50~1000 |
| | | OLEOSOAB PW-190 10.0 | *1 |
| 4 | Polybutene HV-35 80.0 | OLEOSOAB PW-170 20.0 | 50~100 |
| 5 | Polybutene HV-35 40.0 Polybutene HV-50 37.5 | OLEOSOAB PW-170 22.5 | 30~100 |
| 6 | Polybutene HV-10 87.0 | OLEOSOAB PW-170 4.0 | 50~2000 |
| | | OLEOSOAB PW-190 9.0 | *2 |
| 7 | Liquid paraffin 85.0 | OLEOSOAB PW-170 5.0 | 50~2000 |
| | | OLEOSOAB PW-190 10.0 | *3 |
| 8 | Polybutene HV-15 85.0 | NORSOREX NS 15.0 | 25~250 |

(Note) Particle sizes of the mixed gels
*1 a mixture of a particle size of 50 to 100 $\mu$m and that of 300 to 1000 $\mu$m
*2 a mixture of a particle size of 50 to 100 $\mu$m and that of 300 to 2000 $\mu$m
*3 a mixture of a particle size of 50 to 100 $\mu$m and that of 300 to 1000 $\mu$m

Comparative Example 1

| | |
|---|---|
| Polybutene HV-15 (manufactured by Nippon Petrochemicals Co., Ltd.) | 91.0% by weight |
| AEROSIL R972 (manufactured by Nippon Aerosil Co., Ltd.; hydrophobic silica) | 9.0% by weight |

The above components were mixed and kneaded by means of three rolls until the hydrophobic silica was homogeneously dispersed to obtain an ink follower for a writing tool. Thereafter, two kinds of ballpoint pens with a water-base ink were obtained in a similar manner to Example 1.

Comparative Example 2

| | |
|---|---|
| Di-2-ethylhexyl phthalate | 99.4% by weight |
| GELIOL D (manufactured by New Japan Chemical Co., Ltd.; dibenzylidene sorbitol) | 0.6% by weight |
| UNIBEADS SPL-200 (manufactured by Union Co., Ltd.; spherical particles made of glass; 200 μm of average particle size) | 44.0% by weight |

The above components were mixed at 150° C. to obtain an ink follower for a writing tool. Thereafter, two kinds of ballpoint pens with a water-base ink were obtained in a similar manner to Example 1.

Comparative Example 3

| | |
|---|---|
| Silicone oil (manufactured by Toray Dow Corning Silicone Co., Ltd.) | 89.5% by weight |
| AEROSIL R972 (manufactured by Nippon Aerosil Co., Ltd.; hydrophobic silica) | 7.0% by weight |
| RHEODOL SP-030 (manufactured by Kao Corporation; sorbitan trioleate) | 0.5% by weight |
| Polybutene HV-15 | 3.0% by weight |

The above components were mixed and kneaded by means of three rolls until the hydrophobic silica was homogeneously dispersed to obtain an ink follower for a writing tool. Thereafter, two kinds of ballpoint pens with a water-base ink were obtained in a similar manner to Example 1.

Comparative Test

The two kinds of ballpoint pens obtained as above were evaluated according to the following test items at the time immediately after the preparation and after the pens were left to stand with the tip upward at 50° C. for 2 months. Table 2 shows the results.

(evaluation items, evaluation methods, and judging standards) Ink-following ability Writing was carried out at a speed rate of 4 m/minute (normal writing level) or 10 m/minutete (shorthand writing level), and the written lines were evaluated by eye.

○: The written lines were not patchy in both cases of 4 m/minute and 10 m/minute.

Δ: The written lines were not patchy in the case of 4 m/minute but were patchy in the case of 10 m/minute.

×: The written lines were patchy in both cases of 4 m/minute and 10 m/minute.

Impact Resistance

The capped ballpoint pens with the tip upward were dropped from the height of 30 cm to a Japanese cedar plate successively 100 times. Thereafter, the state of the ink followers was evaluated by eye.

○: No ink leaked from the pen end.

×: The ink follower was destroyed and the ink leaked from the pen end.

Oil Separation

It was evaluated by eye whether the base oil was observed in the ink.

○: No oil separation was observed.

Δ: Slight oil separation was observed but there was no problem in writing.

×: Oil separation was observed and there was a problem in writing.

TABLE 2

| | Early stage | | | After 2 months at 50° C. | | |
|---|---|---|---|---|---|---|
| | Ink-following ability | Impact resistance | Oil separation | Ink-following ability | Impact resistance | Oil separation |
| Example 1 | ○ | ○ | ○ | ○ | ○ | ○ |
| Example 2 | ○ | ○ | ○ | ○ | ○ | Δ |
| Example 3 | ○ | ○ | ○ | ○ | ○ | ○ |
| Example 4 | ○ | ○ | ○ | ○ | ○ | ○ |
| Example 5 | Δ | ○ | ○ | Δ | ○ | ○ |
| Example 6 | ○ | ○ | ○ | ○ | ○ | ○ |
| Example 7 | ○ | ○ | ○ | ○ | ○ | ○ |
| Example 8 | ○ | ○ | ○ | ○ | ○ | Δ |
| Comparative Example 1 | Δ | ○ | ○ | x | ○ | ○ |
| Comparative Example 2 | ○ | x | ○ | ○ | x | x |
| Comparative Example 3 | ○ | x | ○ | ○ | ○ | ○ |

The ink follower of the present invention overcome all the problems of impact resistance, stability with the passage of time, ink-following ability, oil separation, and the like, at least one of which any conventional ink follower had, and exhibited the performance of an excellent ink follower. Furthermore, the performance of a writing tool at which it was arranged could be improved.

What is claimed is:

1. An ink follower for a writing tool arranged in contact with an ink surface opposite to a part of an ink reservoir to which a writing tip is attached, said ink follower comprising a swollen gel formed from an oil-absorbable resin and a base oil of a hardly volatile liquid and/or a nonvolatile liquid.

2. The ink follower for the writing tool according to claim 1, wherein the oil-absorbable resin is a polymer having lipophilicity.

3. The ink follower for the writing tool according to claim 1, wherein the swollen gel which forms the ink follower is a gel having a particle size of 30 to 2000 μm.

4. The ink follower for the writing tool according to claim 1, wherein the swollen gel which forms the ink follower is a mixture of a gel having a particle size of 30 to 100 μm and a gel having a particle size of 300 to 1500 μm.

5. The ink follower for the writing tool according to claim 1, wherein the mixing amount of the oil-absorbable resin is from 10 to 20% by weight.

6. The ink follower for the writing tool according to claim 1, wherein the oil-absorbable resin is one or more selected from acrylate ester crosslinked polymer and/or copolymer thereof, methacrylate ester crosslinked polymer and/or copolymer thereof, and polynorbornene.

7. The ink follower for the writing tool according to claim 6, wherein said acrylate ester crosslinked polymer and/or copolymer thereof, methacrylate ester crosslinked polymer and/or copolymer thereof are a crosslinked copolymer obtained from polymerizing a monomer having one polymerizable unsaturated group having a structure of

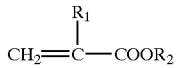

(wherein, $R_1$ is hydrogen or methyl group, and $R_2$ is a aliphatic hydrocarbon group having 10 to 16 carbon atoms) and a crosslinking monomer having at least two polymerizable unsaturated groups.

8. The ink follower for the writing tool according to claim 7, wherein said crosslinking monomer having at least two polymerizable unsaturated groups is one selected from acrylate or methacrylate of glycol including ethylene glycol, diethylene glycol, polyethylene glycol, polypropylene glycol, 1,3-butylene glycol and 1,6-hexane glycol; acrylamide including N,N'-methylenebisacrylamide, N,N'-propyleneacrylamide; polyfunctional acrylate or methacrylate of polyhydric alcohol including glycerin, trimethylolpropane, trimethylolethane and tetramethylolmethane or alkylene oxide adducts thereof; and divinylbenzene.

9. A writing tool wherein ink is directly charged into an ink reservoir and an ink follower is arranged in contact with an ink surface opposite to a part to which a writing tip is attached, the ink follower being an ink follower according to claim 1.

10. The writing tool according to claim 9, wherein the writing tool where ink is directly charged into an ink reservoir and a writing tip is attached is a writing tool where the writing tip is directly attached to the ink reservoir.

11. The writing tool according to claim 7, wherein the writing tool where ink is directly charged into an ink reservoir and a writing tip is attached is a writing tool where the writing tip is attached to the ink reservoir through an ink-feed controller.

12. The ink follower for the writing tool according to claim 1, wherein said base oil is one or more selected from a mineral oil-type base oil and a synthetic base oil including spindle oil, castor oil, olive oil, liquid paraffin, polybutene and soybean oil.

13. The ink follower for the writing tool according to claim 1, wherein an SP value of the base oil is between 7 and 9.

14. The ink follower for the writing tool according to claim 1, wherein an SP value of the ink is other than between 7 and 9.

* * * * *